United States Patent [19]

Matsumoto et al.

[11] Patent Number: 4,778,206

[45] Date of Patent: Oct. 18, 1988

[54] CONTROL SYSTEM FOR A DOOR LOCK OF A MOTOR VEHICLE

[75] Inventors: Rempei Matsumoto, Ohta; Mitsuru Yamazaki, Ojima, both of Japan

[73] Assignee: Fuji Jukogyo Kabushiki Kaisha, Tokyo, Japan

[21] Appl. No.: 35,638

[22] Filed: Apr. 3, 1987

[30] Foreign Application Priority Data

Apr. 14, 1986 [JP] Japan ..... 61-085240

[51] Int. Cl.[4] ..... E05C 31/02

[52] U.S. Cl. ..... 292/201

[58] Field of Search ..... 70/263, 264; 292/280, 292/216, 201, 336.3

[56] References Cited

U.S. PATENT DOCUMENTS 4,364,249 12/1982 Kleefeldt ..... 292/201 X

FOREIGN PATENT DOCUMENTS 78962 5/1983 European Pat. Off. ..... 70/263

58-222267 12/1983 Japan .

*Primary Examiner*—Richard E. Moore

*Attorney, Agent, or Firm*—Martin A. Farber

[57] ABSTRACT

A control system comprises a remote control system and a keyless entry system. The remote control system has an electromagnetic wave communication system including a portable transmitter transmitting a signal modulated in accordance with a code and a receiver provided in the motor vehicle to receive the modulated signal and to demodulate it to produce a code signal. The code signal is compared with a registered code signal. When the code signal coincides with the registered code signal, an actuator is operated to lock and unlock a door. The keyless entry system has a manual operating device provided on a handle of the door. The manual operating device has at least one switch manually operated so as to produce an on-off signal. When the on-off signal coincides with the registered code signal, the actuator is operated.

12 Claims, 2 Drawing Sheets

CONTROL SYSTEM FOR A DOOR LOCK OF A MOTOR VEHICLE

BACKGROUND OF THE INVENTION

The present invention relates to a system for locking and unlocking a door lock of a motor vehicle.

A keyless entry system which operates to unlock a lock of a door without using a key is disclosed in Japanese Patent Laid-Open Application No. 58-222267. The system has a code input device, a discriminator for an input code and an actuator for unlocking the door lock in response to an output signal of the discriminator.

However, such a keyless entry system has a disadvantage that it takes time to input the code signal to unlock the door lock.

As a system for quickly unlocking the door lock, a remote control system employed with a portable code transmitter for operating an unlock actuator is available. However, since such a transmitter serves as a kind of key for the door lock, a driver should always carry the transmitter. Further, it is useless when a battery of the transmitter is run down, or when the transmitter is left in the vehicle.

SUMMARY OF THE INVENTION

The object of the present invention is to provide system for actuating a door lock of a motor vehicle which is systematically combined with a keyless entry system and a remote control system, whereby the door lock can be quickly unlocked by a transmitter and can be unlocked without the transmitter.

According to the present invention, there is provided a control system for a door lock of a motor vehicle comprising a communication system including a portable transmitter transmitting a signal modulated in accordance with a code and a receiver provided in the motor vehicle to receive the modulated signal and to demodulate it to produce a code signal, a discriminator having a registered code signal and receiving the code signal, for deciding whether the code signal coincides with the registered code signal and for producing an output signal when coinciding, an actuator responsive to the output signal for operating the door lock to lock and unlock the door lock, and a manual operating device provided on an outside member of a door having the door lock, the manual operating device having at least one switch manually operated so as to produce an on-off signal, the on-off signal being applied to the discriminator for determining whether the on-off signal coincides with the registered code signal, for operating the actuator.

In an aspect of the invention, the communication system is an electromagnetic wave communication system and the manual operating device is a handle of the door.

DETAILED DESCRIPTION OF THE PREFERRED EMBODIMENT

Figure 1:
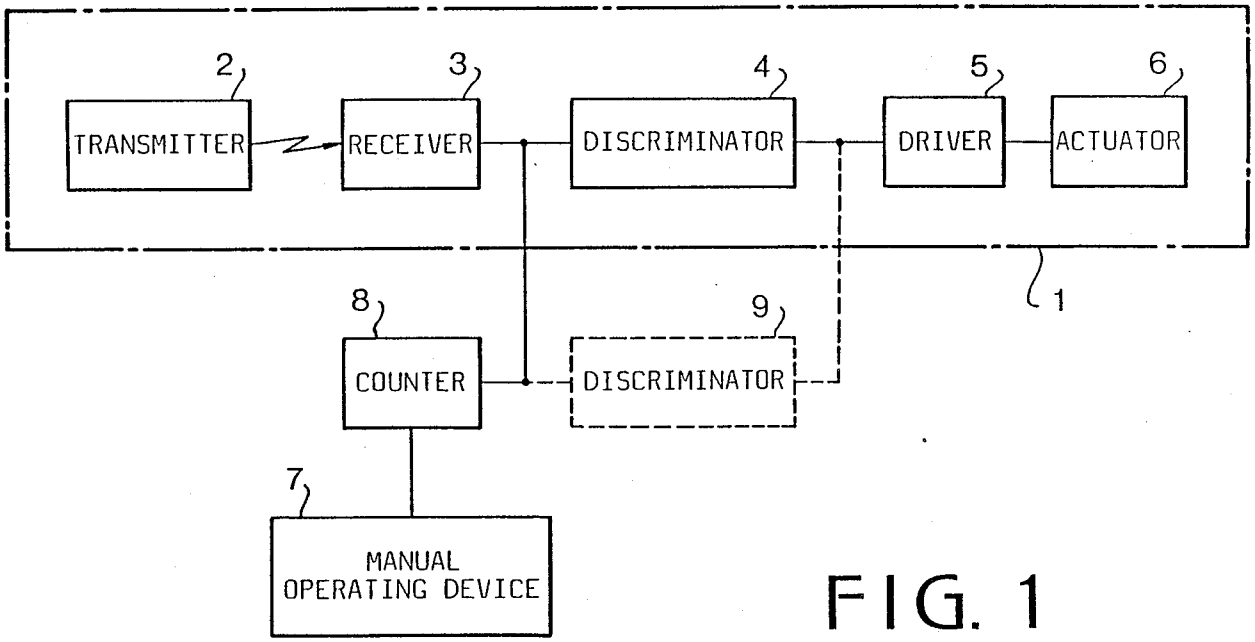
FIG. 1 is a block diagram showing a system for a door lock of a motor vehicle according to the present invention.
Figure 2:
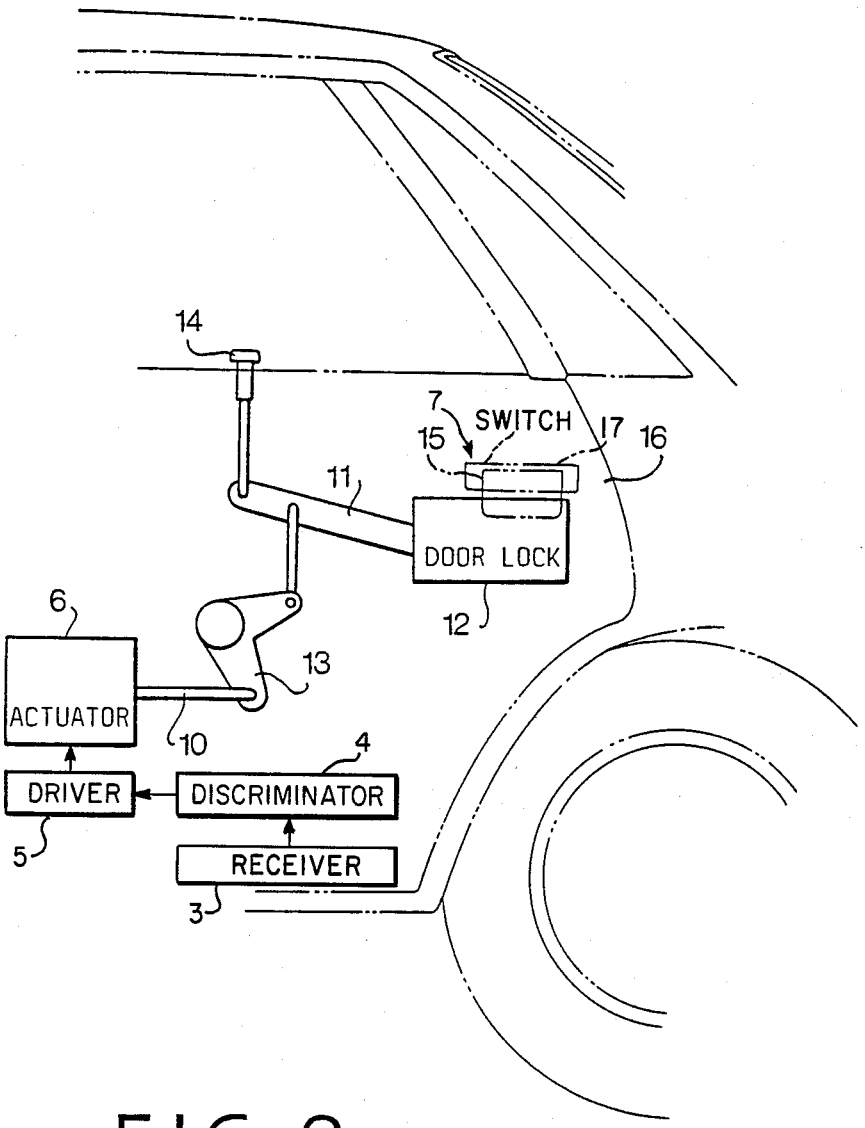
FIG. 2 is a schematic illustration showing a door lock and an actuator.

Referring to the FIGS. 1 and 2, a system for a door lock of a motor vehicle of the present invention comprises a remote control system 1 employed with infrared rays or electromagnetic waves. The remote control system 1 has a portable transmitter 2 carried by a driver. In the motor vehicle, a receiver 3, a discriminator 4, and an actuator 6 provided in a door 16 and operated by an output of a driver 5 are mounted.

Referring to FIG. 2, the actuator 6 having an electromagnetic solenoid or an electric motor is provided to reciprocate a rod 10 which is operatively connected to a lever 11 of a door lock 12 through a bell crank 13. A knob (button) 14 is connected to the lever 11 so as to manually operate the door lock 12. The transmitter 2 is operated to transmit electromagnetic waves modulated by a code or an intelligence signal. The transmitter 2 and receiver 3 may be substituted with another communication system such as operated by infrared beams.

When the driver operates the transmitter 2 within a predetermined range with respect to the door lock of the vehicle to transmit the electromagnetic waves, the receiver 3 receives the radiated waves from the transmitter 2 and demodulates the wave to the original code signal. The code signal is applied to the discriminator 4. The discriminator 4 examines whether or not the input signal coincides with the predetermined code signal. When the two signals coincide with each other, the discriminator 4 produces an output signal. The output signal is applied to the actuator 6 through the driving circuit 5, so that the door lock is locked or unlocked.

The system of the invention has a further control system for the door lock. In order to lock and unlock the door from the outside of the vehicle by manual operation, a manual operating device 7 is provided on an outside member in the door. The operating device has a switch 17 which is operated by moving a movable member such as an outer handle 15 (FIG. 2) for opening the door or pushing a push button provided on the handle or a keyboard provided on the door. The siwtch is repeatedly operated in accordance with a pattern corresponding to the code to produce pulses. The pulses are applied to a counter 8 (FIG. 1) where the pulses are counted and converted to a code signal. The code signal is applied to the discriminator 4 of the remote control system 1. The discriminator 4 examines whether the code signal and the predetermined recorded signal for the keyless entry system are the same or different. When the two signals are the same, the output signal is applied to the actuator 6 through the driver 5 to unlock the door lock.

In the embodiment, the discriminator 4 has two functions to examine code signals for a remote control system and a keyless entry system. However, as shown in a dotted line in FIG. 1, a discriminator 9 for the keyless entry system may be provided.

In an operating device using a keyboard having numeric keys from 0 to 9, the keys (switches) are depressed in accordance with a code number, so that a code signal is delivered to the discriminator 4 or 9.

In accordance with the present invention, a control system for a door lock is provided with a remote control system operated by a portable transmitter and additionally provided with a keyless entry system.

Accordingly, the remote control system and the keyless entry system can be conveniently used dependent on the situation.

While the presently preferred embodiments of the present invention has been shown and described, it is to be understood that this disclosure is for the purpose of illustration and that various changes and modifications may be made without departing from the spirit and scope of the invention as set forth in the appended claims.

What is claimed is:

1. A control system for a door lock on a door of a motor vehicle, comprising:

a remote control communication system including portable transmitter means for transmitting a signal modulated in accordance with a code, and receiver means provided in said motor vehicle for receiving said modulated signal and for demodulating said modulated signal for producing a first code signal corresponding to said code;

discriminator means for having a registered code signal and for receiving said first code signal, for determining whether said first code signal coincides with said registered code signal and for producing an output signal when said first code signal coincides with said registered code signal;

actuator means responsive to said output signal for operating said door lock to lock and unlock said door lock;

a keyless manual operating device provided on an outside member of the door having said door lock;

said manual operating device having at least one switch means manually operable for producing an on-off signal representing a second code signal;

said second code signal being applied to said discriminator means, the latter for determining whether said second code signal coincides with said registered code signal for producing said output signal when said second code signal coincides with said registered code signal for operating said actuator means.

2. The control system according to claim 1 wherein the communication system is an electromagnetic wave communication system.

3. The control system according to claim 1 wherein the manual operating device is a handle of the door.

4. The control system according to claim 1, wherein the communication system is an infrared ray communication system.

5. A control system for a door lock on a door of a motor vehicle, comprising:

a remote control communication system including portable transmitter means for transmitting a signal modulated in accordance with a code, and receiver means provided in said motor vehicle for receiving said modulated signal and for demodulating said modulated signal for producing a first code signal corresponding to said code;

discriminator means for having a registered code signal and for receiving said first code signal, for determining whether said first code signal coincides with said registered code signal and for producing an output signal when said first code signal coincides with said registered code signal;

actuator means responsive to said output signal for operating said door lock to lock and unlock said door lock;

a keyless manual operating device provided on an outside member of the door having said door lock;

said manual operating device having at least one switch means manually operable for producing an on-off signal representing a second code signal and another discriminator means having said registered code signal;

said second code signal being applied to said another discriminator means, the latter for determining whether said second code signal coincides with said registered code signal for producing said output signal when said second code signal coincides with said registered code signal for operating said actuator means.

6. The control system according to claim 5, wherein said switch means is for producing pulses when manually operated, said pulses constituting said on-off signal, said manual operating device having counter means connected between said switch means and said another discriminator means for counting the pulses and for converting said pulses into said second code signal.

7. The control system according to claim 1, wherein said switch means is for producing pulses when manually operated, said pulses constituting said on-off signal, said manual operating device having counter means connected between said switch means and said discriminator means for counting the pulses and for converting said pulses into said second code signal.

8. The control system according to claim 1, wherein said door lock includes mechanical means for manually completely mechanically operating the door lock.

9. The control system according to claim 8, wherein said mechanical means is a button.

10. The control system according to claim 9, further comprising lever means operatively connected at one end thereof to said door lock for operating the door lock to lock and unlock said door lock, said button is connected to said lever means, adjacent another end of said lever means, a rod connected to said actuator means for reciprocating said rod, a bell crank connected to said rod and said lever means at an intermediate portion of said lever means.

11. The control system according to claim 1, wherein said outside member of the door is an outer handle for opening the door, and said switch means is connected to said outer handle so as to be manually operated by movement of said handle.

12. The control system according to claim 1, wherein said outside member of the door is an outer handle for opening the door, and said switch means is connected to a push button on said outer handle so as to be manually operated by movement of said push button.

* * * * *